United States Patent [19]

Dalliard

[11] Patent Number: 4,641,587

[45] Date of Patent: Feb. 10, 1987

[54] SUSPENDED MOTORIZED VEHICLE

[75] Inventor: Fernand Dalliard, Villeneuve, Switzerland

[73] Assignee: Ateliers de Constructions Mecaniques de Vevey S.A., Switzerland

[21] Appl. No.: 627,611

[22] Filed: Jul. 3, 1984

[30] Foreign Application Priority Data

Jul. 4, 1983 [CH] Switzerland ..... 3747/83

[51] Int. Cl.[4] ..... B61B 3/02

[52] U.S. Cl. ..... 105/3; 105/154; 105/156; 104/95; 104/112

[58] Field of Search ..... 104/95, 89, 112; 105/154, 3, 148, 156

[56] References Cited

U.S. PATENT DOCUMENTS

| | | | |
|---|---|---|---|
| 947,384 | 1/1910 | Hanson | 105/154 |
| 3,543,687 | 12/1970 | Ellzey | 105/154 X |
| 3,568,605 | 3/1971 | Pettit | 105/154 X |
| 4,069,765 | 1/1978 | Muller | 104/112 X |
| 4,182,243 | 1/1980 | Ceauselu | 105/154 X |

*Primary Examiner*—Robert B. Reeves
*Assistant Examiner*—David F. Hubbuch

[57] ABSTRACT

The invention relates to a suspended motorized vehicle traveling on a line consisting, in its straight sections, of rails placed on track cables held by suspender cables tied to main cables and comprising, for the curved sections, rigid shapes supported by brackets or crossbeams making it possible to change the direction of the vehicles. The invention proposes mounting of wheel sets supported independently of one another, comprising load equalizing bars, and independent motorizing of the wheels.

7 Claims, 12 Drawing Figures

SUSPENDED MOTORIZED VEHICLE

Motor vehicles traveling suspended from a track have already been used for decades. But the extension of their use has not occurred as hoped, probably because their line, consisting of rigid elements, requires a great number of towers or supporting crossbeams involving acquisition of considerable land, making this system as burdensome as other known and tried means of urban transportation such as streetcars, motor buses, trolley buses, etc.

Recently, suspended vehicle systems have appeared, the line consisting of one or more cables placed horizontally and made very taut. The towers supporting these cables are extended upward, and at least a second cable also taut forms a festoon above the first cable which is connected to the second by suspender cables by using the same principle as that of suspension bridges. This design results in allowing great cable spans, the towers being able to be placed several hundred meters apart. As a result there is a great reduction in acquisition of land, the necessary foundation works, the weight of the superstructures, and consequently in the cost of the installation. It is obvious that this system is especially advantageous for straight paths and allows only very slight curves. The sections comprising sharp curves must be built differently by resorting, for example, to rigid tracks carried by towers or crossbeams.

But the system of lines consisting essentially of horizontal cables, made very taut and supported, on the one hand, by supports on the towers and, on the other hand, by the suspender cables attached to an upper cable, exhibit great elasticities both in the vertical and horizontal planes. The presence of masses in movement on this line entails a considerable risk of vibrations whose frequencies could enter into resonance with the frequencies of the line itself, each of whose suspender cables induces a change in direction of the track cable and constitutes a vibratory excitation whose frequency is equal to the speed of advance measured in m/s divided by the pitch of the suspender cables, expressed in m.

The purpose of this invention is to remedy said drawbacks by reducing the suspender cable effect and, further, to improve the traveling stability by use of wheels that are independent both in rotation and suspension.

More precisely the invention relates to a vehicle for transporting passengers and/or freight comprising a body suspended from wheels, some of which are driving wheels and which travel on two tracks placed side by side with a constant guage, characterized in that the vehicle is suspended from the tracks by a central part in the shape of a fork with two prongs directed upward which straddle the tracks, the plane going through the axes of the prongs being perpendicular to the lengthwise direction of the tracks, where each prong end comprises a joint with a horizontal shaft around which an equalizing bar pivots in a vertical plane parallel to the corresponding track, the ends of each equalizing bar comprising a wheel, mounted by a bearing, which travels on the corresponding track and where the fork is connected in its middle to the vehicle body by a thrust bearing pivoting around a vertical shaft.

The twelve figures show two possible embodiments of the invention.

The parts that correspond to each other in these figures all carry the same reference number, according to the following list.

Figure 1:
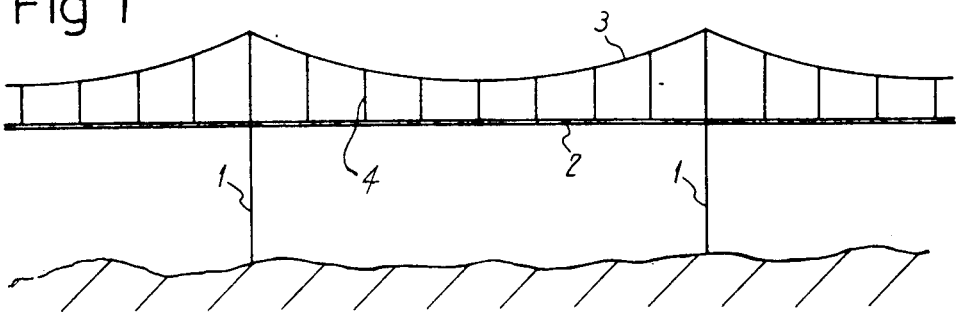
FIG. 1 is a very diagrammatic view of the superstructure for straight sections showing the towers, lines, main cables and suspender cables.
Figure 5:
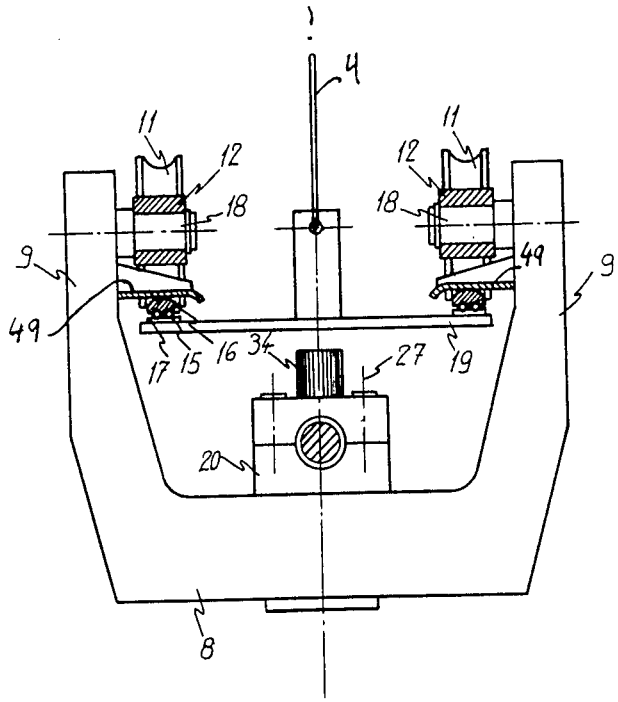
FIG. 5 is a front view of the fork.

1. tower
2. two-track line
3. main cable
4. suspender cable
5. pillar
6. crossbeam
7. girder
8. fork
9. prong
10. fork sleeve
11. wheel
12. equalizing bar
13. wheel bearing
14. wheel shaft
15. track cable
16. track rail
17. cable fastening part
18. equalizing bar joint
19. inverted T support of two tracks
20. spherical connection
21. auxiliary equalizing bar
22. joint of auxiliary equalizing bar
23. frame head
24. spherical thrust cap
25. spherical traction cap
26. spherical housing
27. fastening screw of spherical connection
28. body section
29. bellows
30. connecting rod
31. joint
32. connecting rod support
33. frame
34. guide shaft
35. fork guide bearing
36. auxiliary connecting rod
37. joined connection of auxiliary connection connecting rod 36 to frame 33.
38. shape
39. fork thrust bearing
40. fastening
41. guide rollers of carrying wheel set 11
42. carrying arm
43. drive motor 44. drive pulley
45. receiving pulley
46. set of V-belts
47. brake disk
48. wheel set
49. anti-fall support FIG. 1 shows the constitutive elements of the line, seen in elevation and consisting of two tracks, each comprising one or more cables made horizontally very taut. These cables are covered with a thin running rail or track (16) to avoid wear of the cable itself, during operation of the vehicles. The vehicle wheels travel on each of these tracks, as will be seen below. The two tracks are connected to one another, as shown in FIG. 5, by an inverted T support (19) whose horizontal arm carries the track cables (15) surmounted by the protective rail (16); in the case of the figure, two cables (15) have been shown for each track, but it would be possible to achieve the same aim by using either a single cable with a larger diameter or by assembling a larger number of cables of small diameter. Each inverted T connecting support (19) is attached in its middle axis to the main cable (3) by a suspender cable (4). The main cable (3) forms a festoon above the cable of the line, the unit exhibiting the same image as a standard suspension bridge. This type of design of the line makes it possible to place it in built-up areas, requiring acquisition of only an extremely small amount of land corresponding to the towers. Of course, each of these cables should be permanently prestretched so that the track remains approximately horizontal, despite the passage of the vehicle. This design has very important advantages because the distance between two consecutive towers can be very great, on the order of several hundred meters.

This line can also be used in wet areas (marshes, rivers) where the tower can be placed on a suitably anchored float. The path of the tracks carried by the cables should be in a vertical plane because of the initial tensions to which the cables (2) and (3) are subjected.

However, slight curves are possible; it is essential that the towers (1) be rigorously aligned in a straight line. But the system described above does not allow passage of curves having a small radius. The design must be different but similar to that shown in FIGS. 2 and 3. Travel is no longer on cables held by suspender cables but on lines (2) carried by a lengthwise girder (7) shown in here in the shape of a double T, held in position by crossbeams (6) carried by pillars (5). Other ways of supporting girder (7) would be possible, e.g., by a bracket.

Figure 2:
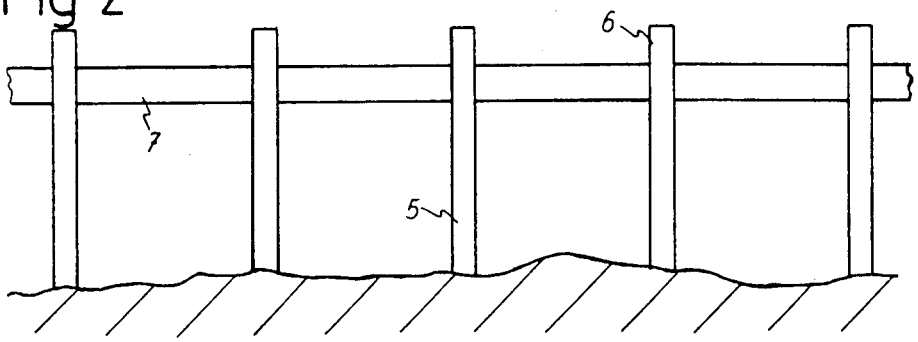
FIG. 2 is also a view of the superstructure for curved sections of small radius. The line then consists of a girder carried by crossbeams.
Figure 3:
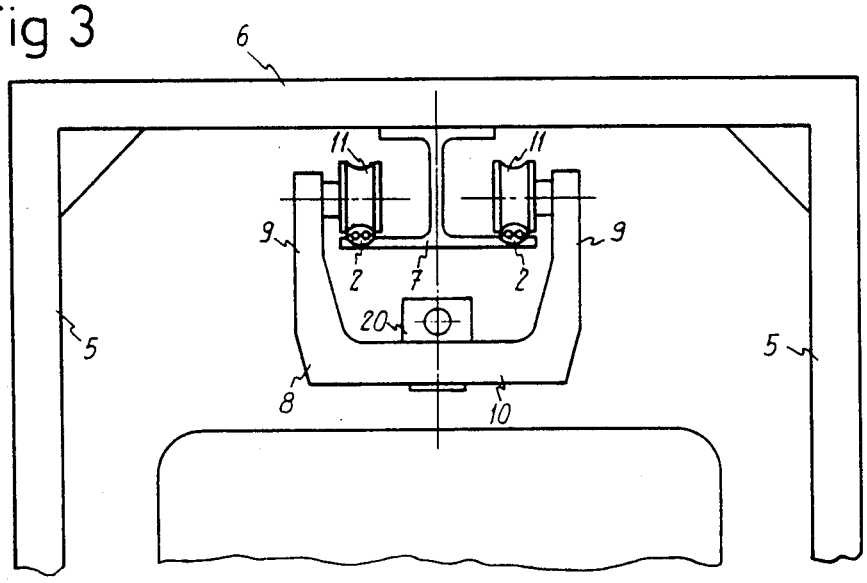
FIG. 3 is a crosswise view of the curved line.

FIG. 3, which is a crosswise view of FIG. 2, shows the arrangement of the tracks (2) which is the same as that of FIG. 1. Passage from one system to the other is done gradually, the speed of the vehicle having to be suited to the curves as necessary. FIG. 3 also shows that the wheels (11) are attached to one another by a fork (8) with two prongs (9) which carry these wheels. This fork is connected to the bodies of the vehicle by a spherical connection (20).

Figure 4:
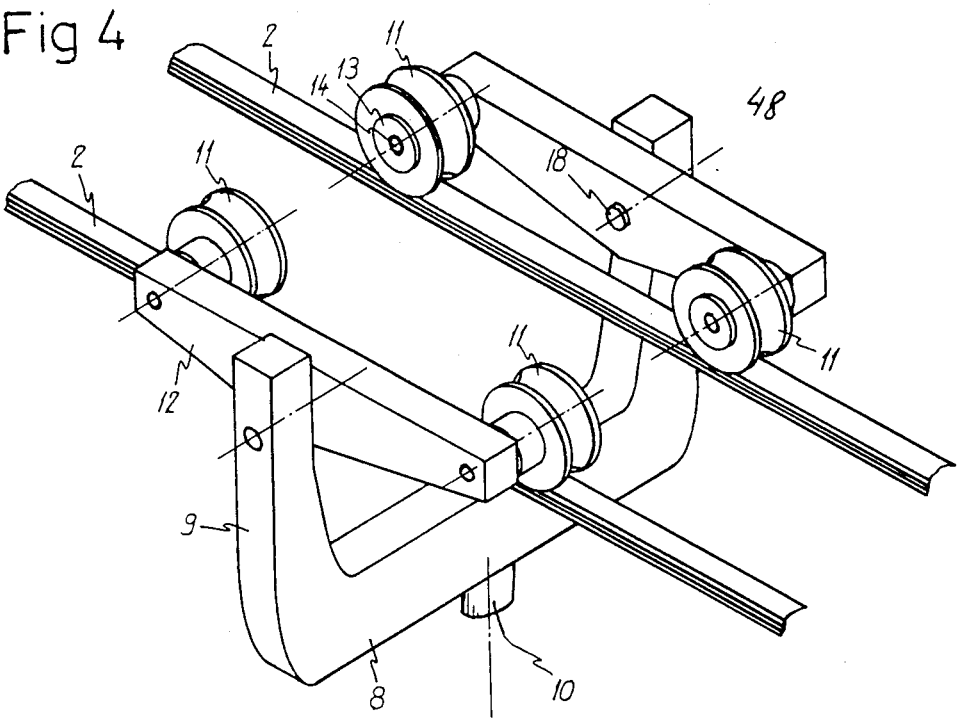
FIG. 4 is a perspective view of a fork with equalizing bars carrying a 4-wheel set.

FIG. 4 shows in perspective the functioning of the equalizing bars and a fork of a wheel set. The fork (8) comprises two vertical prongs (9) at whose ends are fastened the joints (18) of the equalizing bars (12). The equalizing bars (12) pivot around these joints on each side in a vertical plane, and carry at each end a wheel (11) by a wheel bearing (13) facilitating its rotation on its shaft. The fork sleeve (10), shown here under the fork for the sake of clarity, is fastened to the vehicle by a spherical connection. This wheel set device has the advantage, regardless of the shape of the line, of equalizing the load by acting on the front and back wheels of the wheel set. Actually, by being carried by equalizing bars hinged in the midpoint, the load is automatically distributed. The device results in reducing the effect of nonlinearities occurring along the line. The tracks of the latter are carried in space by suspender cables that are some meters apart. They exhibit a different bending when the load is between two suspender cables (4) and when it is at right angles with a suspender cable (4). This discontinuity is such as to induce vibrations in the suspensions of the vehicle, vibrations that are considerably reduced here by an increase in the number of carrying wheels.

FIG. 5 shows an elevation view of the fork. In this particular case, the sleeve of the fork (8), instead of being placed in a direction different form the prongs (9), goes in the same direction as they do. This figure shows the spherical connection (20) made up of two pieces placed on one another and fastened to the fork by four fastening screws (27) and two supports (49) fastened to the prongs (9) and placed under the equalizing bars (12) above the tracks (2) of the line. Normally, a play exists between these anti-fall supports (49) and this line. In case of a failure of one of these wheels, e.g. break or derailment, the support comes in contact with the line and keeps the vehicle from falling.

Figure 6:
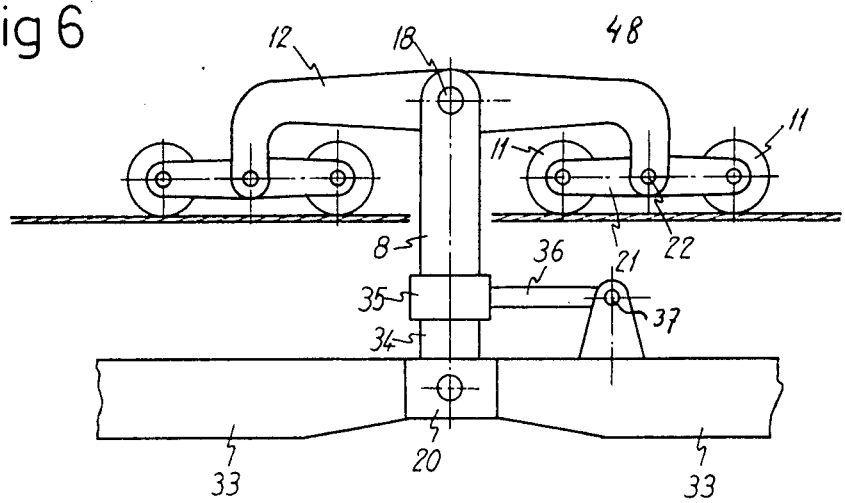
FIG. 6 is a diagrammatic view of an 8-wheel set equalized by equalizing bars.

FIG. 6 is a side view of a wheel set comprising 8 wheels. The functioning is the same as above. The main equalizing bar (12), instead of carrying wheels at its ends, carries auxiliary equalizing bars (21) at whose ends wheels (11) are fastened. The lever arm for each type of equalizing bar (21 and 12) are equal, as are the diameters of the wheels (11). All the wheels of this set carry an identical load and are mobile in a vertical plane. This arrangement has the advantage of considerably reducing the effects of discontinuity in the path of the line. This reduction has the effect of causing an increase in the excitation frequency itself, which, in the particular case, is favorable since it allows an increase in the speed of the vehicle before reaching the resonance frequency of the unit.

Figure 7:
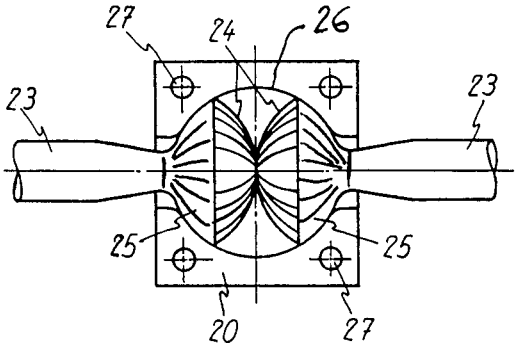
FIG. 7 represents a spherical connection.

FIG. 7 is a plan, detailed view of the spherical connection (20) whose upper half has been removed. This connection comprises a frame head (23) solid with the frame (33) which is extended as (25) by a spherical traction cap which ends with a spherical thrust cap (24). The arrangement is symmetrical for two consecutive frames. The two spherical caps (25) are inscribed in a sphere (26), the ends of the caps (24) resting against one another. The sphere (26) of inscription of the caps consists of the connecting body (20) which comprises two parts cutting this sphere in two hemispheres. A connection of this type allows any oscillation movement around its center by the two ends (23) of frame (33) in relation to one another, whether this oscillation occurs in the vertical or horizontal plane. The distance between these two frames is kept constant and the body carrying the inscribed sphere (20) which is fastened to the fork can pivot around a vertical axis passing through this center. This connection is precisely the one that is carried by the fork (8); it therefore, constitutes a connection of two frames in relation to one another and allows the fork carrying the frames to pivot around a vertical axis and to be oriented along the path and curves of the line.

Figure 8:
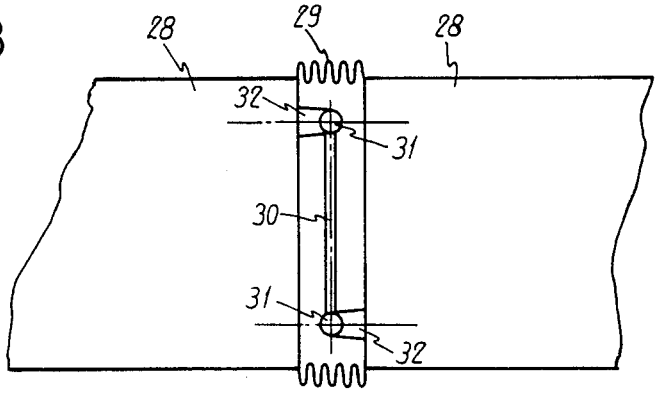
FIG. 8 is a device for connecting the lower parts of two consecutive bodies.

FIG. 8 represents a connecting device connecting two sections of consecutive vehicles so that they will constantly remain in good alignment. Depending on the path, it is necessary that these body sections at times be able to move farther apart or come closer together. For this purpose, this connection is made with a mechanical connection or connecting rod (30) attached at its ends to each of the sections (28) of the vehicle by joints (31) and connecting rod supports (32). This device allows lengthening and shortening of the space between two body sections, but opposes any relative crosswise movement. The body sections are connected to one another by the bellows (29) usual for vehicles of this type, bellows that are well known and used particularly for streetcars and motor buses that are joined.

Figure 9:
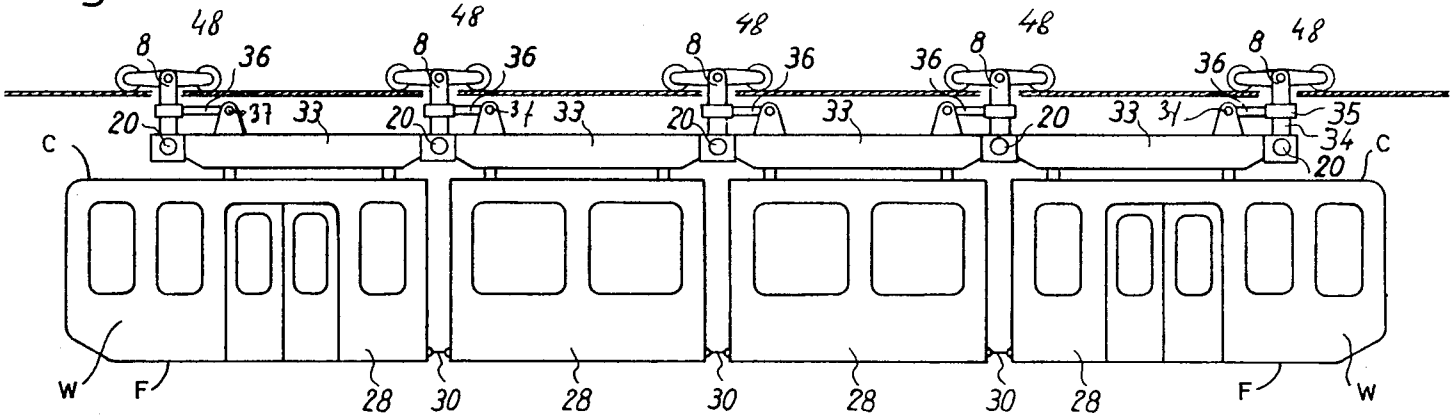
FIG. 9 is an elevation view of a connected vehicle comprising 8 wheel sets.
Figure 11:
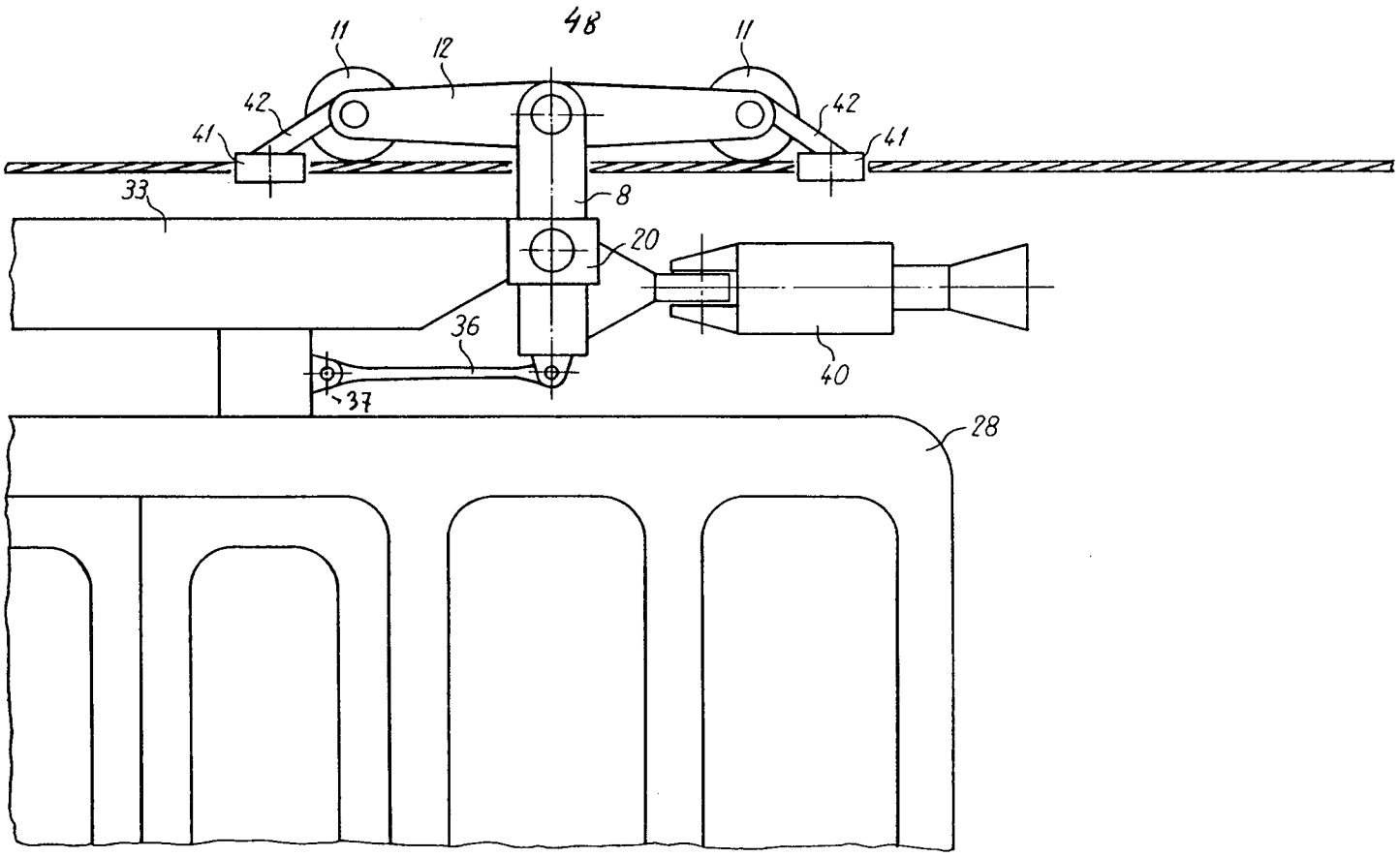
FIG. 11 is an end view of the vehicle.

FIG. 9 shows the vehicle group according to the invention, wherein each body section (28) includes a ceiling or roof (C), walls (W) and floor (F) and includes a frame (33) fastened on its roof, a frame whose end (23) corresponds to that shown in FIG. 11. These ends are connected to one another by the spherical connections (20) which are fastened to the middle of the fork (8). Thus, the group is joined, allowing the vehicle to pass curves of small radius and change direction in the vertical plane. Each of the forks (8) being free around a vertical axis, each train wheel is guided by the line and oriented so that its direction of travel corresponds to the lengthwise axis of the line at the spot where it is located. The figure also shows an additional device represented by an auxiliary connecting rod (36) which is fastened by a joint (37) to the frame (33) and which at its other end carries a guide bearing (35) surrounding the guide shaft (34) which is solid with the fork. This bearing has the effect of constantly maintaining the shaft of the fork in vertical position, this shaft being held between this bearing and the spherical connection (20).

Figure 10:
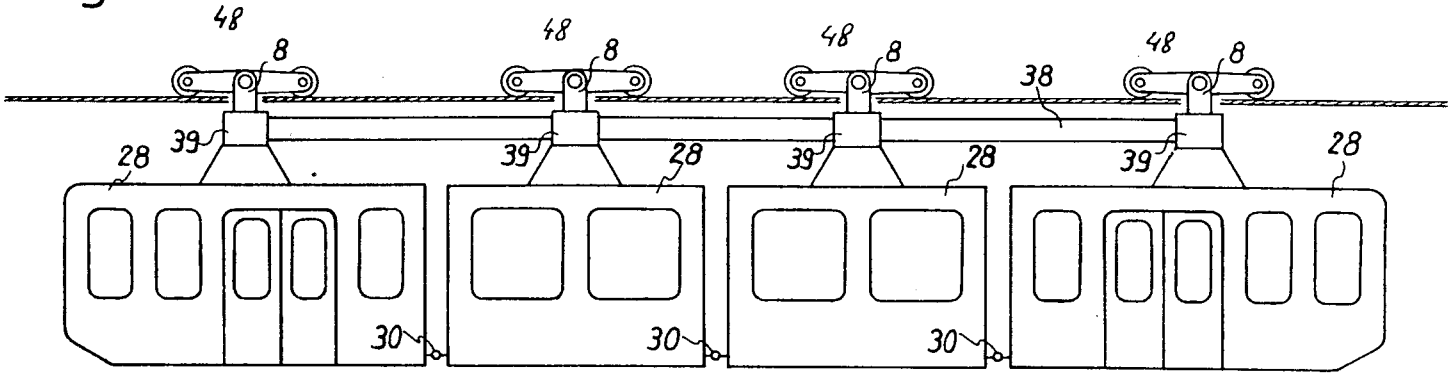
FIG. 10 is an elevation view of a vehicle in another embodiment.

In another embodiment according to FIG. 10, instead of making the vehicle with spherical connections and frames connected to one another, it is possible to surmount the various body sections with a shape (38) in a single piece connecting all the thrust bearings (39) which are fastened to the fork (8). This connection is less flexible than the preceding one, but considering the great lengths involved and the slight curves of the passageway, the shape (38) is selected so that it is flexible enough to deform by bending and fit the line regardless of its path. This device has the advantage of being simpler (therefore less costly) than the preceding one, but has the drawback of also being more rigid and not tolerating curves of small radius. The functioning of the unit remains the same.

FIG. 11 shows a wheel train equipped with additional rollers (41) placed at both ends of the equalizing bar (12) and which rest against one of the side faces of the line. These rollers act on the wheel set and continuously direct it so that the direction of travel of the wheel set constantly corresponds to that of the line. In this figure, two rollers are placed at the front and back, but, of course, the wheel set could comprise two of them placed at the front, or 4 rollers placed at each right and left end of the wheel set. These guide rollers (41) are carried by arms (42) solid with the equalizing bar (12).

In the case of this figure, the auxiliary connecting rod (36), assuring that the fork (8) is kept vertical, is placed below the spherical connection (20), whereas it was placed above it in the case of FIG. 9.

Finally, this figure shows the presence of a coupling device (40) making it possible to couple two or more vehicles to one another to constitute a larger train.

Figure 12:
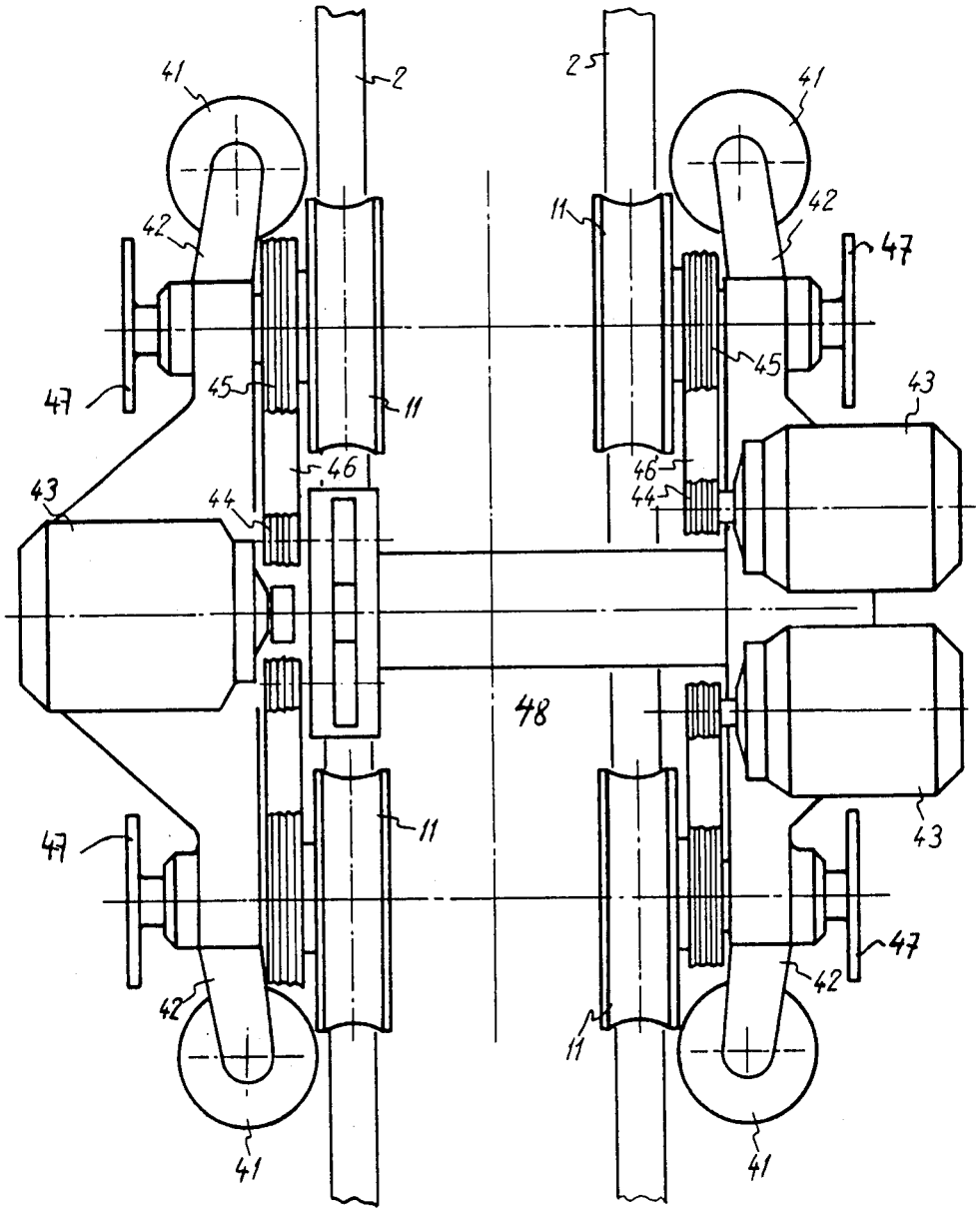
FIG. 12 is a plan view of a motorized wheel set.

FIG. 12 is a plan view, from the top, of a motorized 4-wheel set. This drawing shows two different solutions of this design. To the right of the figure, the wheel set comprises two drive motors (43) carried by the equalizing bar (12) and each comprising a driving pulley (44). The wheels (11) comprise a receiving pulley (45). These two pairs of pulleys are connected by two sets of V-belts (46). To the left of the figure, a drive motor (43) driven by a shaft, not shown in the figure, a gear system comprising a differential that drives in rotation two pulleys (44) aligned with the receiving pulleys (45) solid with the wheels (11). As above, these pairs of pulleys (44) and (45) are connected by two sets of V-belts (46).

Therefore, in this figure, each carrying wheel is a driving wheel. This design has the advantage of making all the driving wheels independent of one another in rotation, their coupling being made only by electrical connections, in the case of the solution shown to the right of the figure, or comprising a differential in the other case. The guide rollers (41) are also shown in this figure. Finally, the shaft of each wheel (11) is extended outward and comprises a disk (47) on which brakes, not shown in the figure, act. These brakes are used to assure stopping of the vehicle at the station and for safety.

The various solutions shown in the figures and described in the text do not comprise any elastic suspension or vibration damper intended to increase the comfort of the vehicle. It is obvious that it is possible to provide such devices, for example, between the wheels (11) and equalizing bars (12) and/or (21), between the fork (8) and the spherical connection (20), or between the frames (33) and (38) and the vehicles.

FIG. 12 shows a possible solution for motorizing the wheels (11) by using V-belt transmissions. Other solutions could also be considered, for example, by placing a motor at the shaft end of some pulleys (11), or by using toothed gearing, etc. Further, it is, of course, not necessary to motorize all the wheels of the vehicle.

Both in the figures and description, no allusion was made to the presence of bellows connecting two consecutive body sections. It is obvious that the body comprises a floor for the passengers to walk on. At right angles with the connection of two body sections, joined elements of this floor are superposed, slide on one another and make a continuous connection despite the curves of the line and its changes in slope.

In the description, it was assumed that the line was in the same plane and, further, was horizontal. But, actually, changes in direction and slope can occur, because the various sections of the vehicle are connected horizontally and can bend vertically in relation to one another.

The energy necessary for motorizing the vehicle, in the present case, is electric. The installation comprises a catenary suspension, not shown in the drawings, bringing energy by means of trolleys. Other modes could be considered, for example, the vehicle carrying on board an electric generator driven by an internal combustion engine or a turbine.

I claim:

1. A suspended motorized vehicle for transporting passengers and/or freight comprising a body (28) suspended on wheels (11) some of which are driving wheels and which travel on two laterally spaced apart tracks (2), the gauge between same being constant, said vehicle suspended from said tracks (2) by a plurality of central unitary forks each (8) having two prongs (9) directed upward above the horizontal plane of said tracks and straddling said tracks (2), the plane passing through the axes of said prongs (9) being perpendicular to the lengthwise direction of said tracks (2), the end of each said prong including a joint (18) provided by a horizontal shaft, an equalizing bar (12) pivotally supported by each said shaft in a vertical plane parallel to a respective one of said tracks, each end of each said equalizing bar (12) provided with one said wheel (11) mounted upon a bearing (13), each said wheel travelling on an adjacent one of said tracks (2), motor means (43) connected to at least one said wheel of each said equalizing bar of at least one said fork for rotating said driving wheels, and said unitary forks (8) each connected in their middle (10) to said body of the vehicle by a thrust bearing (20, 39) pivoting around a vertical shaft, wherein said body (28) of the vehicle is divided into several sections each having means connecting a respective section to at least one adjacent section, each said section including walls, a ceiling and a floor, said connecting means comprising elastic bellows (29) connecting two consecutive said sections to assure the continuity of said walls, ceilings and floors, and wherein each said body section (28) of the vehicle is surmounted by a rigid frame (33) connected to a respective section, said frame including a fastening connecting it to that of at least one adjacent said body section, said fastening disposed between two said frames and located between two consecutive said bodies, a sleeve (10) attached to a medial portion of each said fork, said fastening including a spherical connection (20) allowing oscillations between adjacent ones of said frames both in horizontal and vertical planes, and said thrust bearing connecting said fork sleeves to said body by means of said frame (33).

2. A vehicle according to claim 1, including supports (49) fastened to said prongs (9) of said forks (8) on the inside of the latter and extending to an overlying position above said tracks (2) to define a space between said supports and tracks such that in normal operation, no said support (49) touches an adjacent one said track (2), whereby said tracks (2) and supports (49) come in contact in case of breakdown, preventing the suspended vehicle body (28) from falling.

3. A vehicle according to claim 1, including a roller (41) turning around a vertical shaft placed at the ends of each said equalizing bar (12), said rollers (41) engaging a vertical surface of a respective one of said tracks (2) to cause pivoting of said bars and forks around said thrust bearings connecting said body (28) of the vehicle to said forks (9) so that the direction of travel of said wheels and bars remains identical with the longitudinal direction of said tracks (2).

4. A vehicle according to claim 1, wherein each said body section (28) of the vehicle is connected, adjacent its floor, to an adjacent said section by a mechanical connection preventing any relative crosswise movement between said connected sections whereby said mechanical connections allow relative longitudinal movement between said sections, said mechanical connections comprising a horizontal crosswise connecting rod (30) having a one end (31) connected by a joint to one said body section and another end connected by a joint to another one said section.

5. A vehicle according to claim 1, wherein each said track includes a stretched cable (15) and a protective rail (16) supported atop said cable whereby, said rail is adapted to be engaged by said wheels.

6. A suspended motorized vehicle for transporting passengers and/or freight comprising a body (28) suspended on wheels (11) some of which are driving wheels and which travel on two laterally spaced apart tracks (2), the gauge between same being constant, said vehicle suspended from said tracks (2) by a plurality of central unitary forks each (8) having two prongs (9) directed upward above the horizontal plane of said tracks and straddling said tracks (2), the plane passing through the axes of said prongs (9) being perpendicular to the lengthwise direction of said tracks (2), the end of each said prong including a joint (18) provided by a horizontal shaft, an equalizing bar (12) pivotally supported by each said shaft in a vertical plane parallel to a respective one of said tracks, each end of each said equalizing bar (12) provided with one said wheel (11) mounted upon a bearing (13), each said wheel travelling on an adjacent one of said tracks (2), motor means (43) connected to at least one said wheel of each said equalizing bar of at least one said fork for rotating said driving wheels, and said unitary forks (8) each connected in their middle (10) to said body of the vehicle by a thrust bearing (20, 39) pivoting around a vertical shaft, wherein said body (28) of the vehicle is divided into several sections each having means connecting a respective section to at least one adjacent section, each said section including walls, a ceiling and a floor, said connecting means comprising elastic bellows (29) connecting two consecutive said sections to assure the continuity of said walls, ceilings and floors, and including a sleeve attached to a medial portion of said forks, each said body section (28) of the vehicle surmounted by a rigid frame (33) connected to a respective section, said frames (33) of said sections at the ends of said vehicle having said thrust bearings connecting said frames to said fork sleeves juxtaposed the endmost ones of said sections of the vehicle.

7. A suspended motorized vehicle for transporting passengers and/or freight comprising a body (28) suspended on wheels (11) some of which are driving wheels and which travel on two laterally spaced apart tracks (2), the gauge between same being constant, said vehicle suspended from said tracks (2) by a plurality of central unitary forks each (8) having two prongs (9) directed upward above the horizontal plane of said tracks and straddling said tracks (2), the plane passing through the axes of said prongs (9) being perpendicular to the lengthwise direction of said tracks (2), the end of each said prong including a joint (18) provided by a horizontal shaft, an equalizing bar (12) pivotally supported by each said shaft in a vertical plane parallel to a respective one of said tracks, each end of each said equalizing bar (12) provided with one said wheel (11) mounted upon a bearing (13), each said wheel travelling on an adjacent one of said tracks (2), motor means (43) connected to at least one said wheel of each said equalizing bar of at least one said fork for rotating said driving wheels, and said unitary forks (8) each connected in their middle (10) to said body of the vehicle by a thrust bearing (20, 39) pivoting around a vertical shaft, wherein said body (28) of the vehicle is divided into several sections each having means connecting a respective section to at least one adjacent section, each said section including walls, a ceiling and a floor, said connecting means comprising elastic bellows (29) connecting two consecutive said sections to assure the continuity of said walls, ceilings and floors, and wherein said body sections are joined by a metal shape (38) positioned above said sections and disposed along the longitudinal axis of the vehicle substantially over its entire length, said shape having a section selected to offer sufficient resistance to bending forces acting in a vertical plane and a slight resistance to bending forces acting in a horizontal plane whereby, without exerting considerable forces on said tracks, said shape follows the path of said tracks, taking any curves into account, and said sections connected to said shape at right angles with their median vertical axis and at points vertically aligned with said forks and thrust bearings.

* * * * *